US011732732B2

(12) United States Patent
Geng et al.

(10) Patent No.: US 11,732,732 B2
(45) Date of Patent: Aug. 22, 2023

(54) PERMANENT MAGNET LEAKAGE-FREE LOW-TEMPERATURE PUMP

(71) Applicant: HUNAN NEPTUNE PUMP CO. LTD., Changsha (CN)

(72) Inventors: Jizhong Geng, Changsha (CN); Yinglai Zhou, Changsha (CN); Leijun Wu, Changsha (CN); Zhixin Peng, Changsha (CN)

(73) Assignee: HUNAN NEPTUNE PUMP CO. LTD, Changsha (CN)

( * ) Notice: Subject to any disclaimer, the term of this patent is extended or adjusted under 35 U.S.C. 154(b) by 0 days.

(21) Appl. No.: 17/829,657

(22) Filed: Jun. 1, 2022

(65) Prior Publication Data

US 2023/0016305 A1 Jan. 19, 2023

(30) Foreign Application Priority Data

Jul. 16, 2021 (CN) ..... 202110807046.4

(51) Int. Cl.
*F04D 29/08* (2006.01)
*F04D 25/08* (2006.01)
(Continued)

(52) U.S. Cl.
CPC ..... *F04D 29/588* (2013.01); *F04D 13/06* (2013.01); *F04D 25/0606* (2013.01);
(Continued)

(58) Field of Classification Search
CPC .... F04D 29/588; F04D 13/06; F04D 25/0606; F04D 29/04; F04D 29/046; F04D 29/083;
(Continued)

(56) References Cited

U.S. PATENT DOCUMENTS 2,996,994 A * 8/1961 Wright ..... F04D 13/027 310/104
5,411,366 A * 5/1995 Rockwood ..... F04D 29/061 415/173.5
(Continued)

FOREIGN PATENT DOCUMENTS

CN 201661483 U * 12/2010
CN 206159049 U * 5/2017
(Continued)

*Primary Examiner* — Dominick L Plakkoottam
(74) *Attorney, Agent, or Firm* — Anthony Claiborne

(57) ABSTRACT

The present disclosure relates to the technical field of low-temperature pumps, in particular to a permanent magnet leakage-free low-temperature pump. The permanent magnet leakage-free low-temperature pump comprises a pump body, wherein a pump impeller is arranged in the pump body, the pump impeller and a permanent magnet motor are of a coaxial structure, no coupler device is arranged between the pump impeller and the permanent magnet motor, a motor barrel is arranged in the pump body and connected with an external power source through a wiring device to work, a first flange plate is arranged at the position, located at the front end, of the outer wall of the pump body, and a second flange plate is arranged at the position, located at the rear end, of the outer wall of the pump body.

10 Claims, 11 Drawing Sheets

(51) Int. Cl.

| | |
|---|---|
| ***F04D 25/06*** | (2006.01) |
| ***F04D 29/046*** | (2006.01) |
| ***F04D 29/58*** | (2006.01) |
| ***F04D 29/04*** | (2006.01) |
| ***F04D 13/06*** | (2006.01) |

(52) U.S. Cl.
CPC ..... *F04D 29/04* (2013.01); *F04D 29/046* (2013.01); *F04D 29/083* (2013.01); *F04D 29/086* (2013.01)

(58) Field of Classification Search
CPC ..... F04D 29/086; F04D 7/02; F04D 29/049; F04D 29/2266; F04D 15/0066; F04D 29/007; F04D 29/0416; F04D 29/061; F04D 29/242; F16C 33/664; F16C 33/6659
See application file for complete search history.

(56) References Cited

U.S. PATENT DOCUMENTS

| | | | | |
|---|---|---|---|---|
| 2015/0143822 | A1* | 5/2015 | Chalmers | F04D 13/086 417/424.2 |
| 2017/0191481 | A1* | 7/2017 | Shafer | F04D 13/027 |

FOREIGN PATENT DOCUMENTS

| | | | | |
|---|---|---|---|---|
| CN | 208858591 | U | * | 5/2019 |
| CN | 111706517 | A | * | 9/2020 |
| CN | 215762282 | U | * | 2/2022 |
| CN | 114135495 | A | * | 3/2022 |
| CN | 217518869 | U | * | 9/2022 |

* cited by examiner

PERMANENT MAGNET LEAKAGE-FREE LOW-TEMPERATURE PUMP

CROSS REFERENCE TO RELATED APPLICATION

This patent application claims the benefit and priority of Chinese Patent Application No. 202110807046.4, filed on Jul. 16, 2021, the disclosure of which is incorporated by reference herein in its entirety as part of the present application.

TECHNICAL FIELD

The present disclosure relates to the technical field of low-temperature pumps, in particular to a permanent magnet leakage-free low-temperature pump.

BACKGROUND ART

The external low-temperature pump is mainly applied to the fields of air separation equipment, liquid transfer injection, tank car filling, liquefied natural gas factories, peak shaving stations and the like, and is mainly used for conveying low-temperature media such as liquid argon, liquid oxygen, liquid nitrogen and liquefied natural gas. The pump shaft of a traditional low-temperature pump is mechanically sealed and high in failure rate, and leakage is likely to occur, so that the safety and the reliability are poor, and the maintenance frequency and cost are high. The motor shaft and the pump shaft of the traditional low-temperature pump need to be connected in a coupling mode, the transmission is unstable, the failure rate is high, and the transmission efficiency and reliability are poor. The high-lift pump set in the traditional low-temperature pump is an asynchronous fixed-frequency motor provided with a transmission device to increase the rotating speed of an impeller to achieve the required lift and flow. The transmission mechanism is low in transmission efficiency, large in noise and poor in reliability. Mechanical transmission parts need to be maintained regularly, and the weight of the whole pump set is increased. The driving motor of the traditional low-temperature pump needs a fan to dissipate heat, and the wind noise is large. Meanwhile, hot air is blown to a pump end part to accelerate gasification of a conveyed medium. Moreover, the size and weight of the motor are large, the cooling fan body is also a motor, an external independent power source is needed, and service life requirement and the maintenance requirement are needed. Therefore, the present disclosure provides a permanent magnet leakage-free low-temperature pump.

SUMMARY

The present disclosure aims to provide a permanent magnet leakage-free low-temperature pump to solve the problems that a traditional low-temperature pump in the background art adopts mechanical sealing, the failure rate is high, a motor shaft and a pump shaft need to be connected in a coupling mode, the transmission is unstable, and an asynchronous fixed-frequency motor is adopted to be provided with a speed increaser device to improve the lift, so that the transmission efficiency is low, the noise is large, the reliability is poor, a driving motor needs a fan to dissipate heat, an external power source is needed, and the service life requirement and the maintenance requirement are needed.

In order to achieve the purpose, the present disclosure provides the following technical scheme. A permanent magnet leakage-free low-temperature pump comprises a pump body, wherein a motor barrel is arranged in the pump body, a permanent magnet motor is arranged in the motor barrel, a first flange plate is arranged at the position, located at the front end, of the outer wall of the pump body, a second flange plate is arranged at the position, located at the rear end, of the outer wall of the pump body, a flange is arranged on the first flange plate, the flange is connected with an infusion pump cover, a third flange plate is arranged on the outer wall of a liquid inlet of the infusion pump cover, a fourth flange plate is arranged on the outer wall of a liquid outlet of the infusion pump cover, the outer wall of the fourth flange plate is connected with a clamping sleeve straight joint, the clamping sleeve straight joint communicates with the liquid outlet of the infusion pump cover, a pump impeller is arranged in the infusion pump cover, the permanent magnet motor drives the pump impeller to rotate through a pump shaft, the front end of the pump shaft is coaxially connected with the pump impeller, the second flange plate is also provided with a flange, the flange is connected with a sealing pump cover, the rear end of the pump shaft is rotatably connected with the inner wall of the sealing pump cover, the middle of the sealing pump cover is connected with a clamping sleeve right-angle joint, the clamping sleeve straight joint communicates with the clamping sleeve right-angle joint through a seamless steel tube, an electrical connecting pipe is connected to the position, close to the top, of the outer wall of the sealing pump cover, the electrical connecting pipe is in threaded connection with an electrical adapter through an electrical adapter nut, and the end, away from the electrical connecting pipe, of the electrical adapter is in threaded connection with a wiring device.

Preferably, a first support is in threaded connection with the position, located at the bottom, of the right side of the first flange plate through a bolt, and a second support is in threaded connection with the position, located at the bottom, of the left side of the second flange plate through a bolt.

Preferably, a plurality of drainage grooves arranged in an annular array mode are formed in the inner wall of the motor barrel.

Preferably, a plurality of balance holes distributed in an annular array mode are formed in the side, close to the pump body, of the pump impeller.

Preferably, the pump shaft is connected with the front side of the pump body through a first angular contact ball bearing, the first angular contact ball bearing is embedded in the front side of the inner wall of the pump body, and a bearing washer is arranged on the front side of the first angular contact ball bearing.

Preferably, an impeller front sealing ring is arranged on the outer wall of the front end of the pump impeller, and a pump cover sealing ring is arranged at the joint of the impeller front sealing ring and the infusion pump cover.

Preferably, an impeller rear sealing ring is arranged on the outer wall of the rear end of the pump impeller, and a pump body sealing ring is arranged at the joint of the impeller rear sealing ring and the pump body.

Preferably, the rear end of the pump shaft is connected with the sealing pump cover through a second angular contact ball bearing, the second angular contact ball bearing is embedded in the inner side of the sealing pump cover, and a belleville spring is arranged on the rear side of the second angular contact ball bearing.

Preferably, the clamping sleeve right-angle joint communicates with the belleville spring on the inner side of the sealing pump cover.

Preferably, the permanent magnet motor and the pump body are integrally designed, and a mechanical sealing device is not needed, so that the safe reliability is improved, and the material cost and the maintenance cost are reduced. The permanent magnet motor and the pump impeller are coaxial and integrally connected, and the permanent magnet motor is directly driven without a coupler, so that the installation accuracy is improved, the transmission loss is reduced, and the failure rate is reduced.

A pump inner cavity of the low-temperature pump communicates with a motor inner cavity, and a small amount of low-temperature medium pass through the interior of the motor to lubricate and cool the bearing. The pump impeller is of a balance hole structure, so that the axial thrust borne by the bearing is reduced, the service life of the motor bearing can be prolonged, and the maintenance cost is reduced. A permanent magnet motor body adopted by the low-temperature pump is light in weight, small in size and low in noise, so that the material cost and the maintenance cost are reduced.

Compared with the prior art, the present disclosure has the following beneficial effects.

According to the permanent magnet leakage-free low-temperature pump, the pump body and the motor are integrally designed, a mechanical sealing device is not needed, the safe reliability is guaranteed, and the material cost and the maintenance cost are reduced. The permanent magnet motor and the pump impeller are coaxial and integrally connected, and the permanent magnet motor is directly driven without a coupler, so that the installation accuracy is improved, the transmission loss is reduced, and the failure rate is reduced. A pump inner cavity of the low-temperature pump communicates with a motor inner cavity, and a proper amount of low-temperature medium pass through the interior of the motor to lubricate and cool the bearing. The pump impeller is of a balance hole structure, so that the axial thrust borne by the bearing is reduced, the service life of the motor bearing can be prolonged, and the maintenance cost is reduced. The permanent magnet motor adopted by the low-temperature pump realizes transmission speed regulation through frequency conversion control speed regulation, and a speed change mechanism is not needed. The permanent magnet motor is light in weight, small in size and low in noise, so that the material cost and the maintenance cost are reduced.

Reference signs: 1, pump body; 10, first flange plate; 11, second flange plate; 2, infusion pump cover; 20, third flange plate; 21, fourth flange plate; 3, sealing pump cover; 30, electrical connecting pipe; 4, motor barrel; 40, drainage groove; 5, permanent magnet motor; 50, pump shaft; 6, pump impeller; 60, balance hole; 7, impeller front sealing ring; 8, pump cover sealing ring; 9, impeller rear sealing ring; 12, pump body sealing ring; 13, first angular contact ball bearing; 14, bearing washer; 15, second angular contact ball bearing; 16, belleville spring; 17, clamping sleeve straight joint; 18, seamless steel tube; 19, clamping sleeve right-angle joint; 22, electrical adapter nut; 23, electrical adapter; 24, wiring device; 25, sealing gasket; 26, first support; 27, second support; and 28, metal winding gasket.

DETAILED DESCRIPTION OF THE EMBODIMENTS

The following clearly and completely describes the technical scheme in the embodiments of the present disclosure with reference to the attached figures in the embodiments of the present disclosure. Apparently, the described embodiments are merely a part rather than all of the embodiments of the present disclosure. Based on the embodiment in the present disclosure, all other embodiments obtained by the ordinary technical staff in the art under the premise of without contributing creative labor belong to the scope protected by the present disclosure.

In the description of the present disclosure, it needs to be illustrated that the indicative direction or position relations of the terms such as "center", "longitudinal", "transverse", "length", "width", "thickness", "upper", "lower", "front", "rear", "left", "right", "vertical", "horizontal", "top", "bottom", "inside", "outside", "clockwise" and "anti-clockwise" are direction or position relations illustrated based on the attached figures, just for facilitating the description of the present disclosure and simplifying the description, but not for indicating or hinting that the indicated device or element must be in a specific direction and is constructed and operated in the specific direction, the terms cannot be understood as the restriction of the present disclosure.

In addition, the terms "first", "second", "third" and "fourth" are merely intended for a purpose of description, and shall not be understood as an indication or implication of relative importance or implicit indication of the number of indicated technical features. Therefore, a feature limited by "first", "second", "third" or "fourth" may include one or more features explicitly or implicitly. In the description of the present disclosure, the meaning of "a plurality of" means two or more unless expressly specifically defined otherwise.

Figure 1:
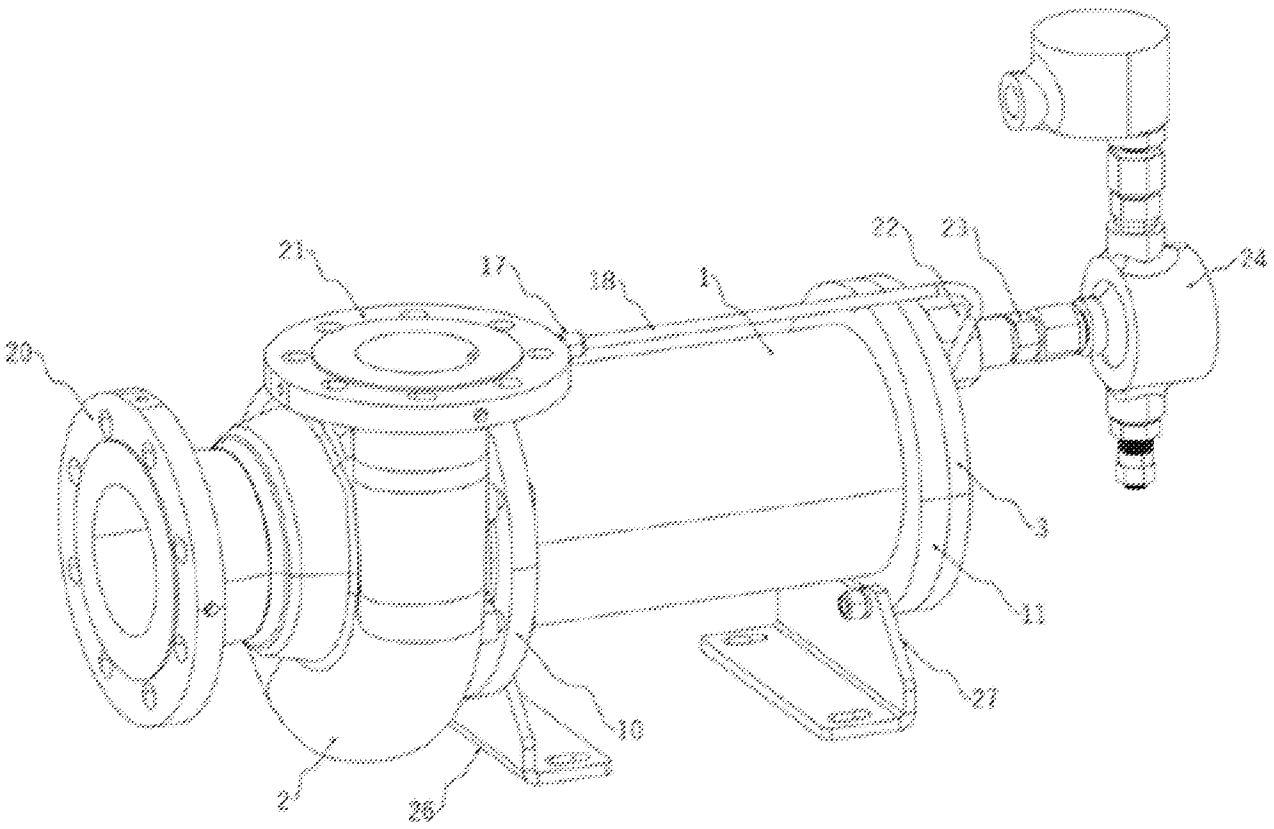
FIG. 1 is an integral structural schematic diagram of the present disclosure in the first perspective.
Figure 2:
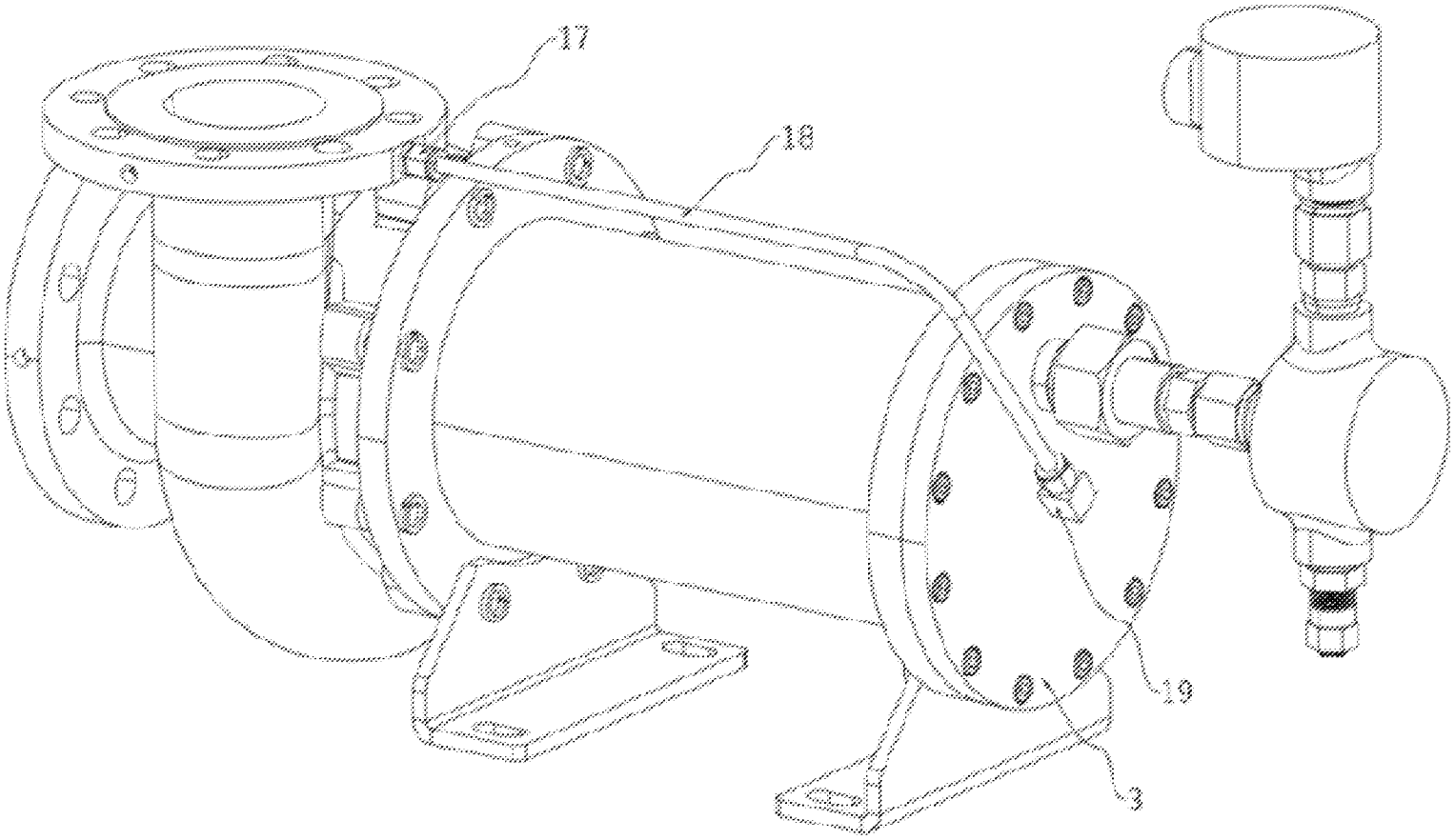
FIG. 2 is an integral structural schematic diagram of the present disclosure in the second perspective.
Figure 3:
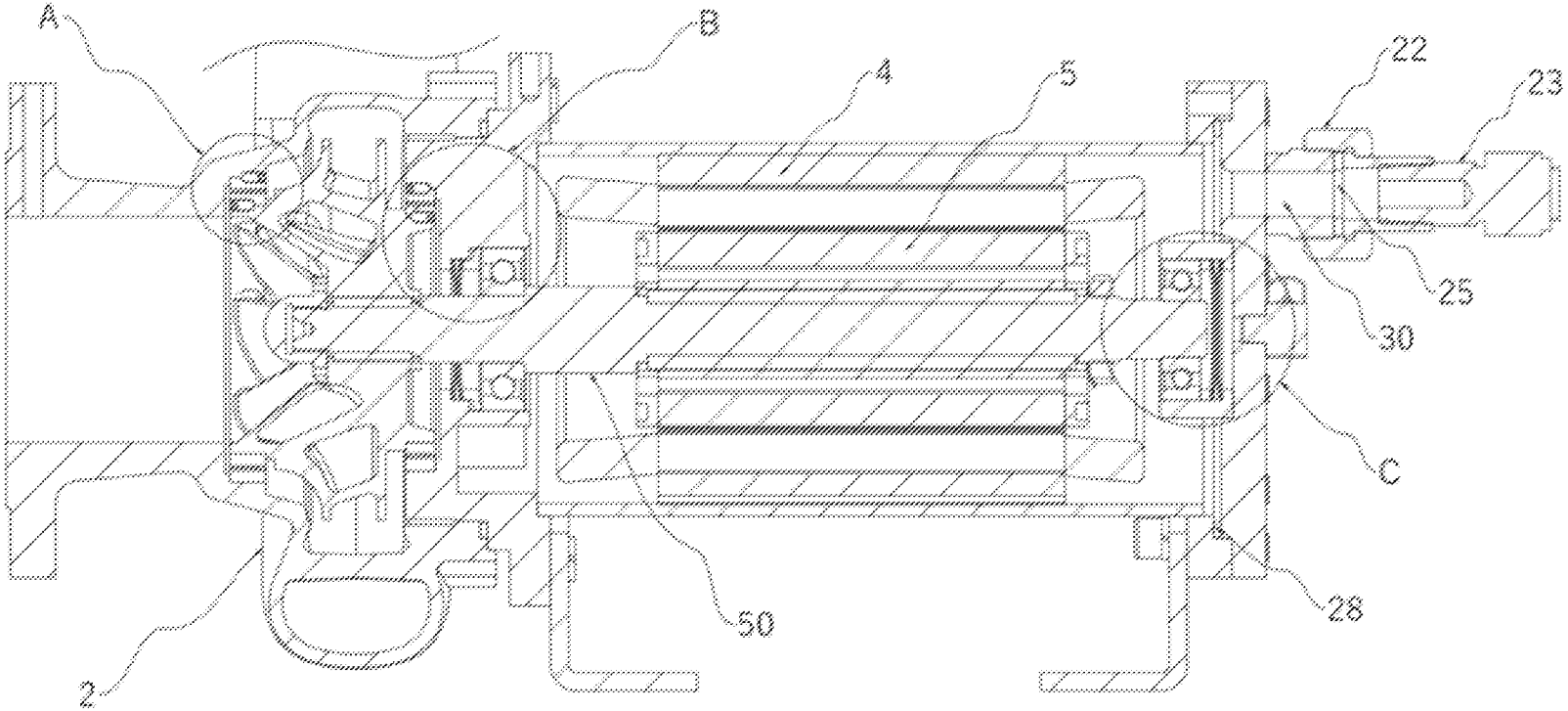
FIG. 3 is the first one of partial structural schematic diagrams of the present disclosure.
Figure 4:
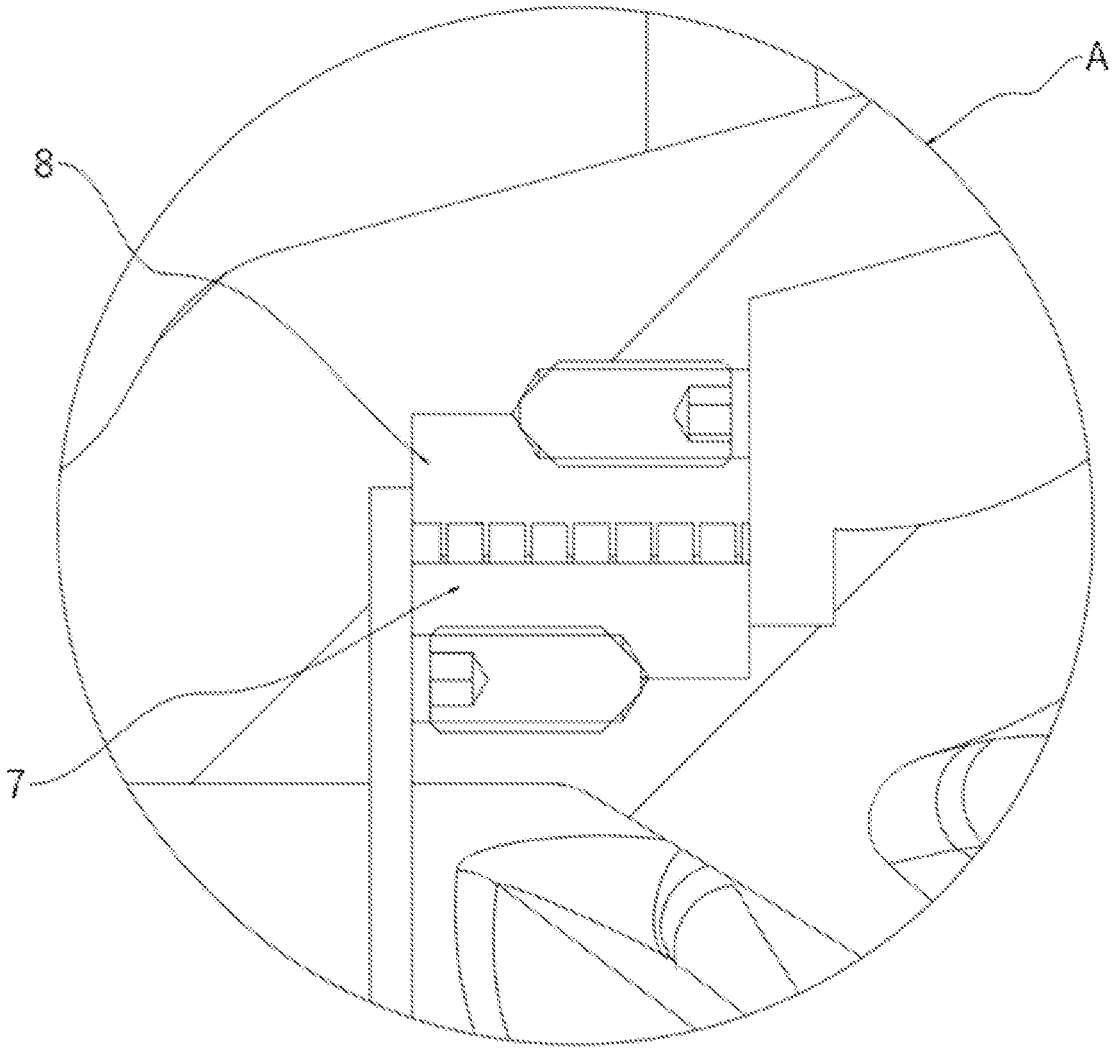
FIG. 4 is an amplified structural schematic diagram of part A of FIG. 3 in the present disclosure.
Figure 5:
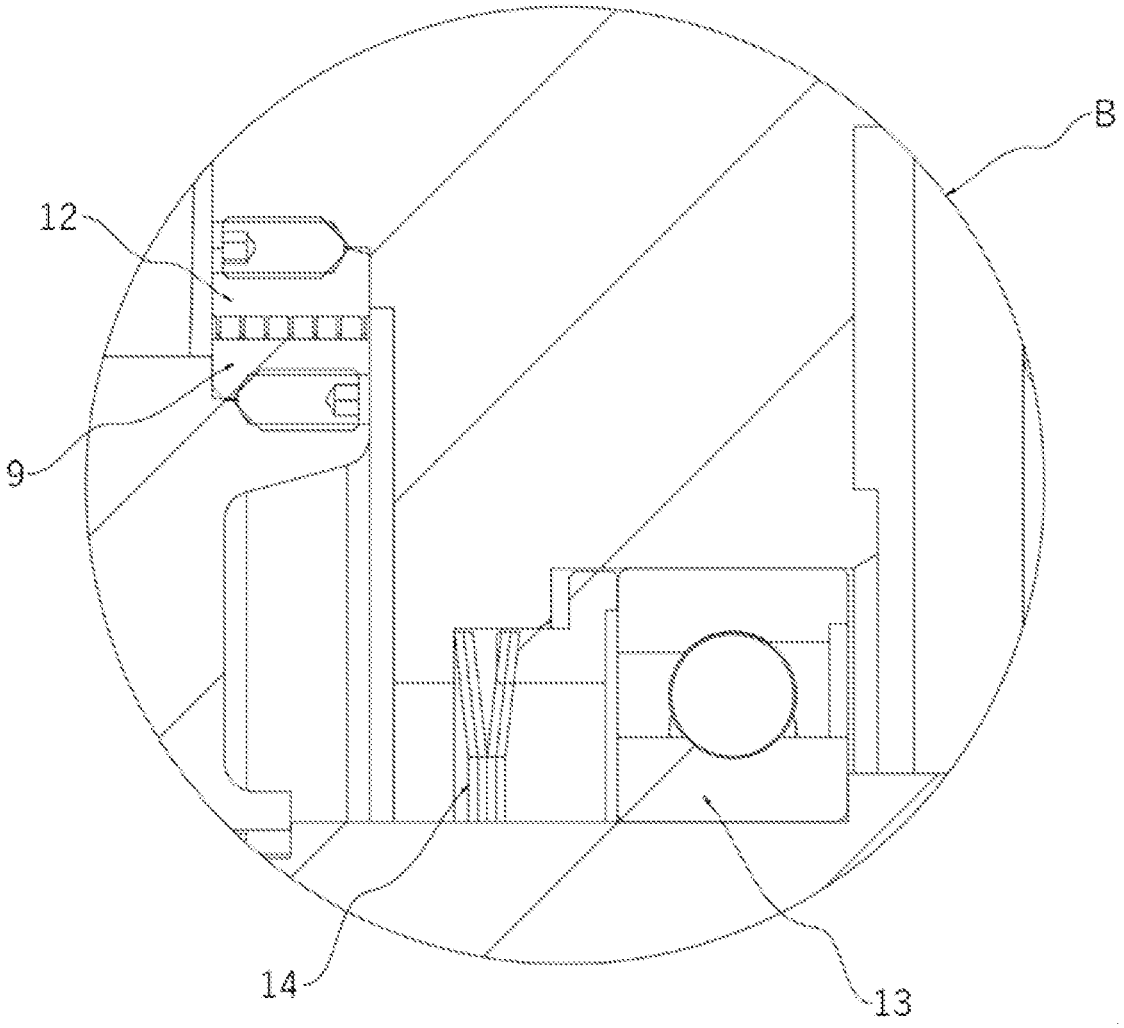
FIG. 5 is an amplified structural schematic diagram of part B of FIG. 3 in the present disclosure.
Figure 6:
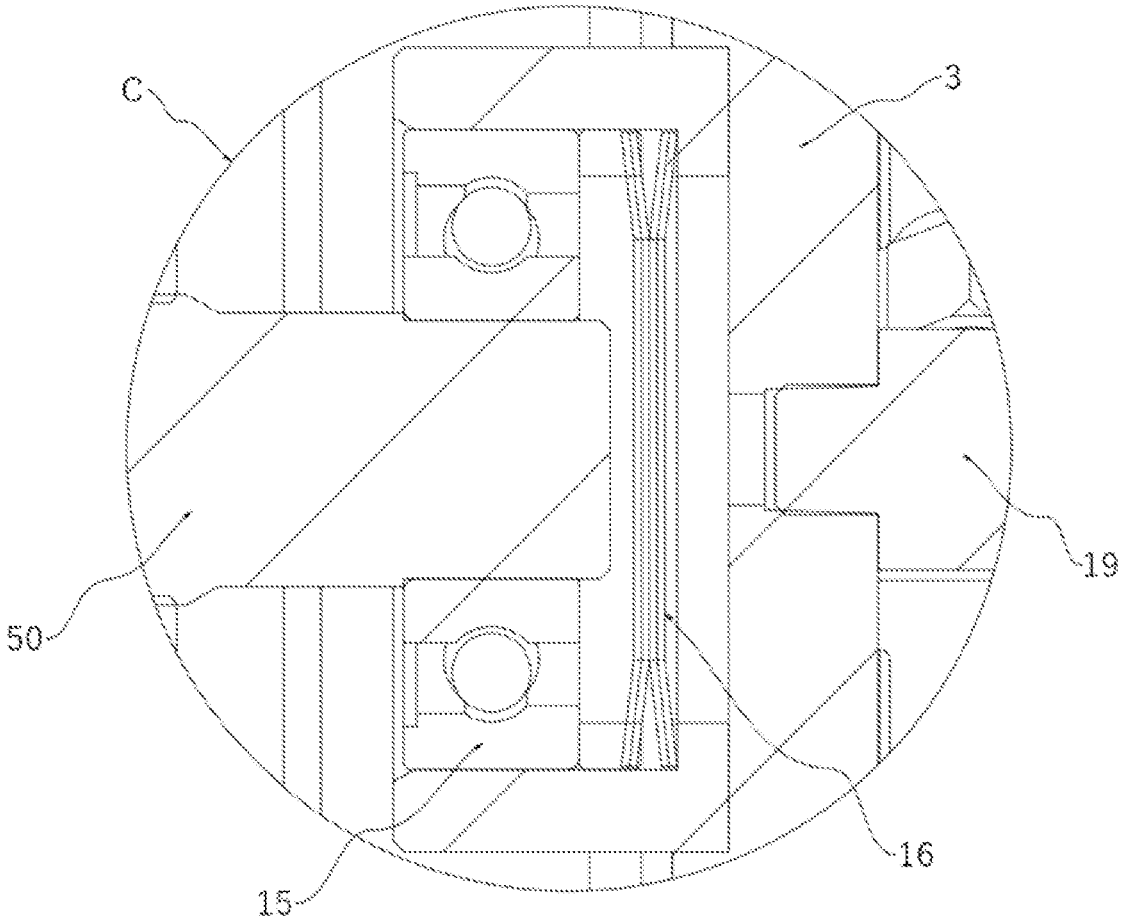
FIG. 6 is an amplified structural schematic diagram of part C of FIG. 3 in the present disclosure.
Figure 7:
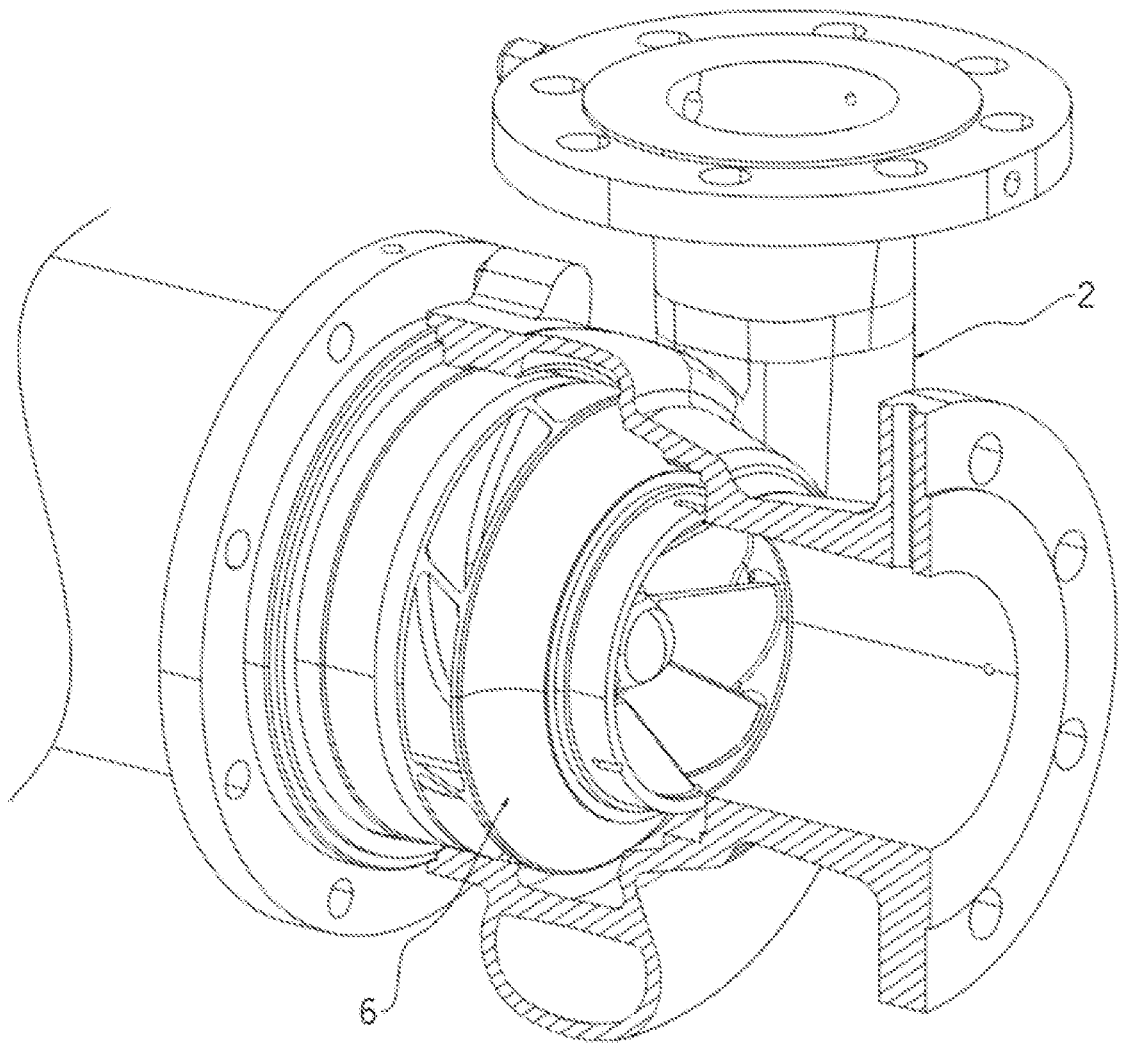
FIG. 7 is an assembled structural schematic diagram of an infusion pump cover and a pump impeller in the present disclosure.
Figure 8:
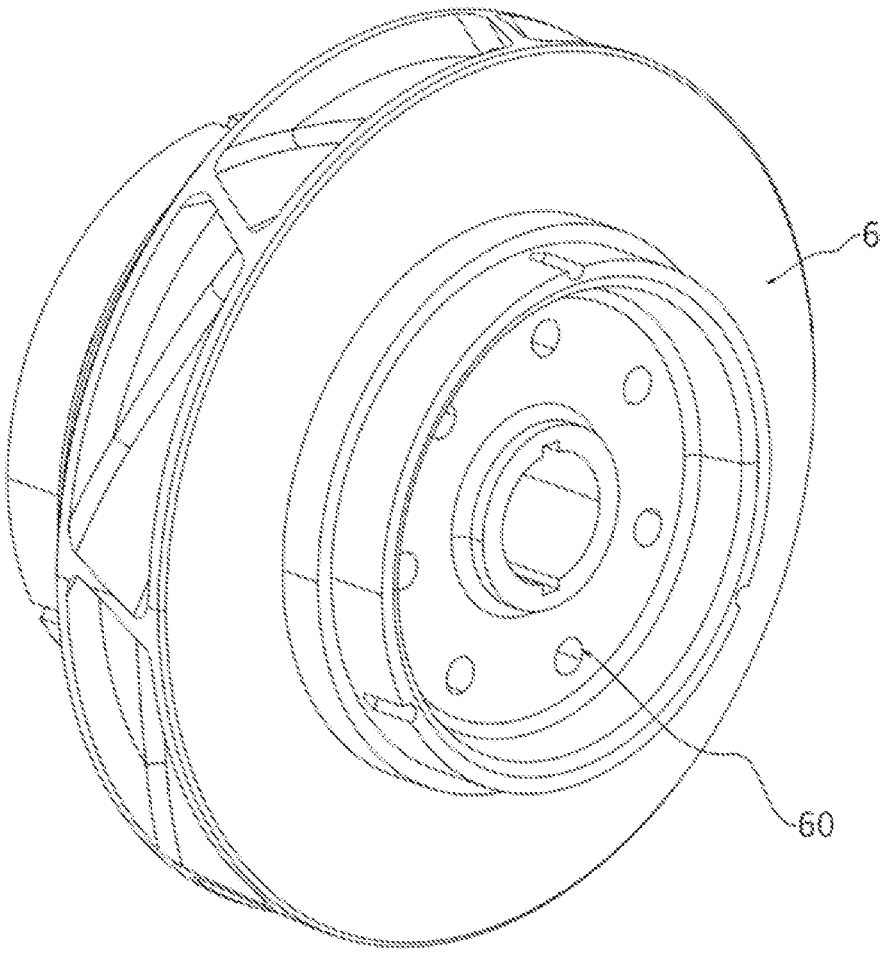
FIG. 8 is a structural schematic diagram of a pump impeller in the present disclosure.
Figure 9:
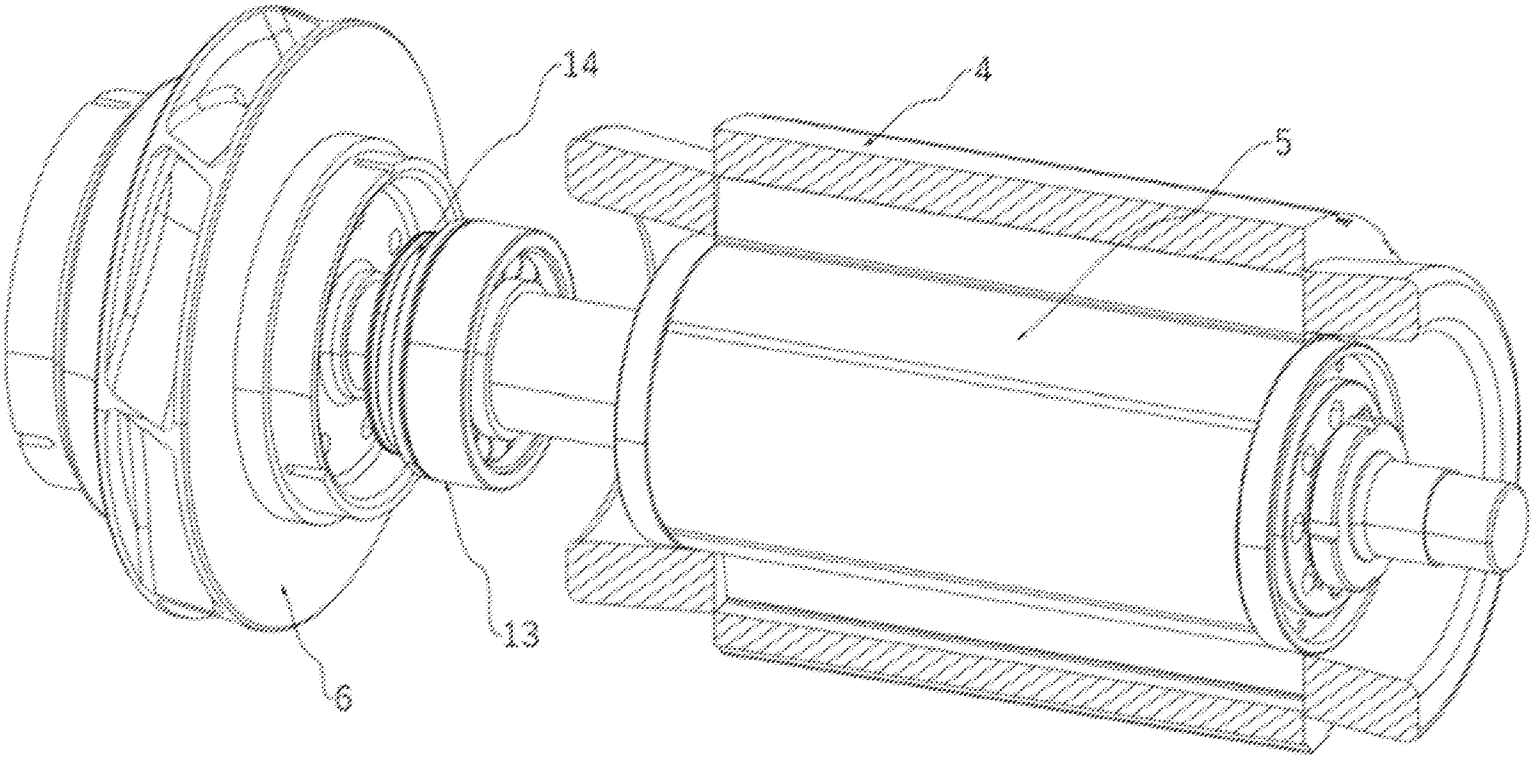
FIG. 9 is the second one of partial structural schematic diagrams of the present disclosure.
Figure 10:
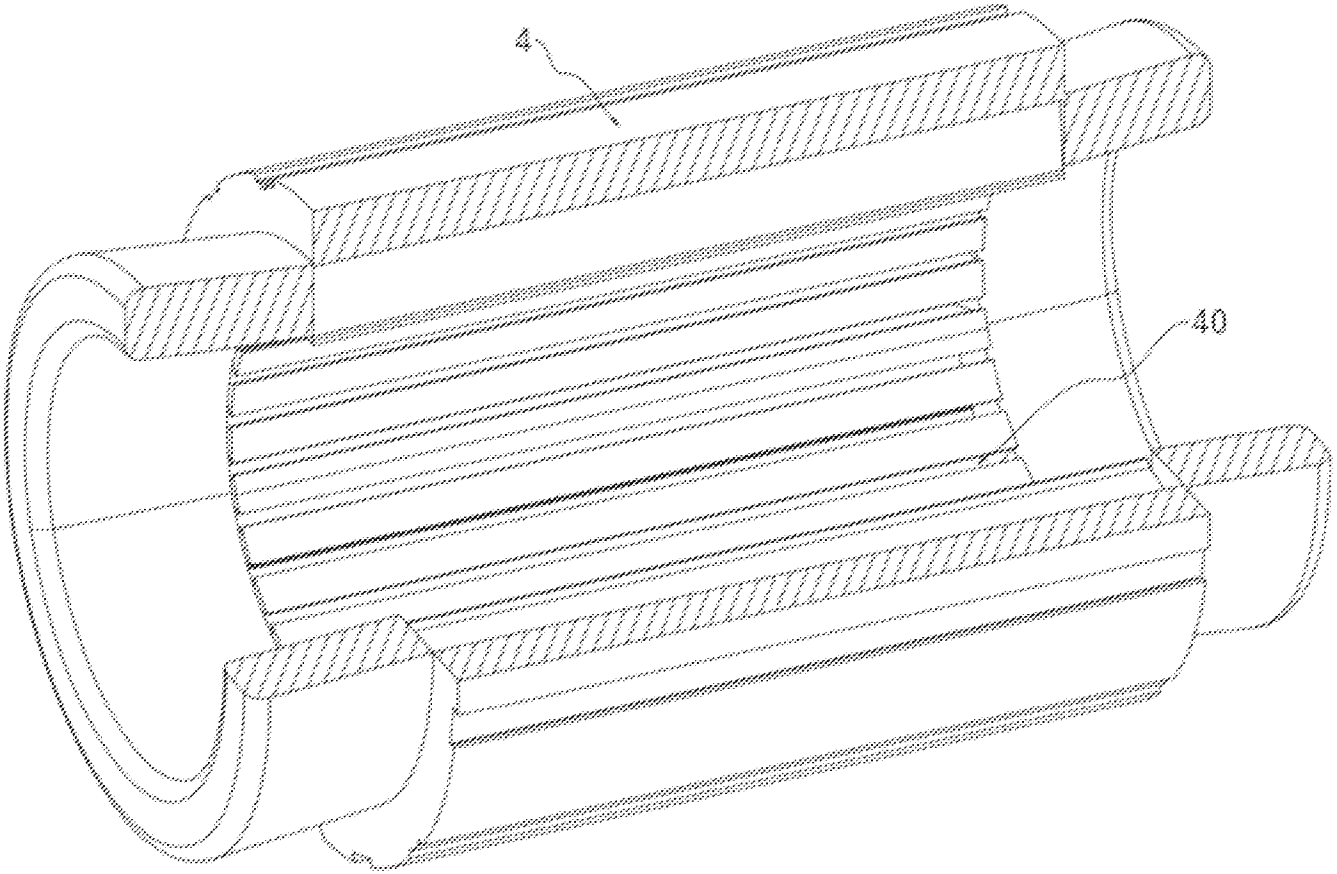
FIG. 10 is a cross-section structural schematic diagram of a motor barrel in the present disclosure.
Figure 11:
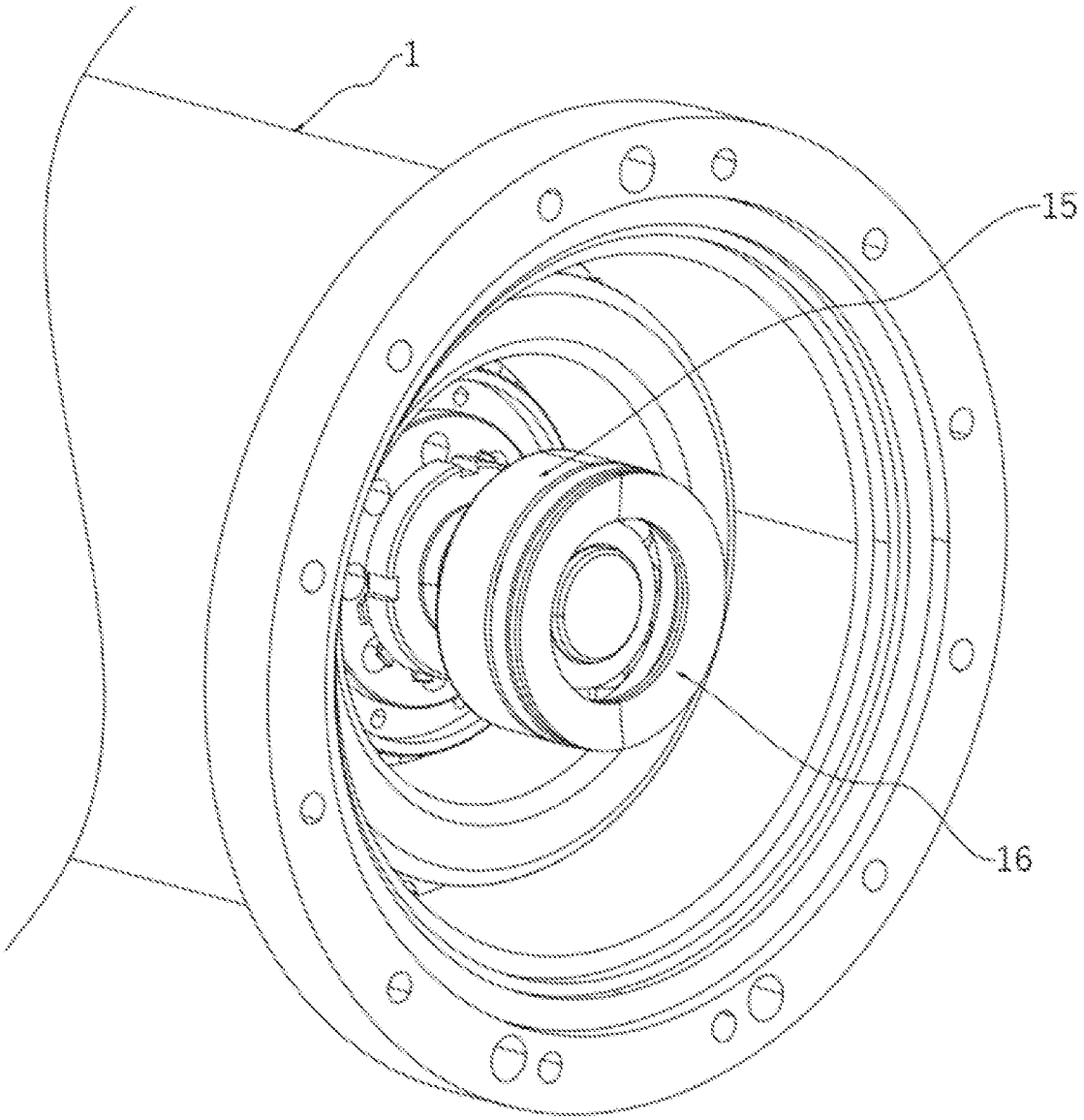
FIG. 11 is the third one of partial structural schematic diagrams of the present disclosure.

Referring to FIG. 1 to FIG. 11, the present disclosure provides the following technical scheme.

A permanent magnet leakage-free low-temperature pump comprises a pump body 1, wherein a motor barrel 4 is arranged in the pump body 1. The motor barrel 4 and the pump body 1 are integrally designed, and a mechanical sealing device is not needed, so that the safe reliability is guaranteed, and the material cost and the maintenance cost are reduced. A permanent magnet motor 5 is arranged in the motor barrel 4. The permanent magnet motor 5 and the pump impeller 6 are coaxial and integrally connected, and the permanent magnet motor 5 is directly driven without a connecting shaft sleeve, so that the transmission loss is reduced, and the failure rate and maintenance are reduced. A first flange plate 10 is arranged at the position, located at the front end, of the outer wall of the pump body 1. A second flange plate 11 is arranged at the position, located at the rear end, of the outer wall of the pump body 1. A flange is arranged on the first flange plate 10. The flange is connected with an infusion pump cover 2. A third flange plate 20 is arranged on the outer wall of a liquid inlet of the infusion pump cover 2. A fourth flange plate 21 is arranged on the outer wall of a liquid outlet of the infusion pump cover 2. The infusion pump cover 2 is conveniently connected with an input pipeline and an output pipeline. The outer wall of the fourth flange plate 21 is connected with a clamping sleeve straight joint 17. The clamping sleeve straight joint 17 communicates with the liquid outlet of the infusion pump cover 2. A pump impeller 6 is arranged in the infusion pump cover 2. The front end of a pump shaft 50 is coaxially connected with the pump impeller 6. The permanent magnet motor 5 drives the pump impeller 6 to rotate through the pump shaft 50. The second flange plate 11 is also provided with a flange. The flange is connected with a sealing pump cover 3. The rear end of the pump shaft 50 is rotatably connected with the inner wall of the sealing pump cover 3, playing a role in positioning the rear end of the pump shaft 50, so that the rotating stability of the pump shaft 50 is improved. The middle of the rear side of the sealing pump cover 3 is connected with a clamping sleeve right-angle joint 19. The clamping sleeve straight joint 17 communicates with the clamping sleeve right-angle joint 19 through a seamless steel tube 18. A proper amount of low-temperature medium passes through an inner cavity of the motor barrel 4 through the clamping sleeve straight joint 17, the seamless steel tube 18 and the clamping sleeve right-angle joint 19 to lubricate and cool a bearing on the permanent magnet motor 5. An electrical connecting pipe 30 is connected to the position, close to the top, of the outer wall of the sealing pump cover 3. The electrical connecting pipe 30 is in threaded connection with an electrical adapter 23 through an electrical adapter nut 22. The end, away from the electrical connecting pipe 30, of the electrical adapter 23 is in threaded connection with a wiring device 24. The electrical adapter 23 is used for transmitting power and data signals from a fixed structure to a rotating structure on 360-degree unlimited continuous rotating mechanical equipment and providing electric energy for the permanent magnet motor 5.

In the embodiment, a first support 26 is in threaded connection with the position, located at the bottom, of the right side of the first flange plate 10 through a bolt, a second support 27 is in threaded connection with the position, located at the bottom, of the left side of the second flange plate 11 through a bolt, and the supports are used for installing the pump body 1.

Specifically, a plurality of drainage grooves 40 arranged in an annular array mode are formed in the inner wall of the motor barrel 4, so that the low-temperature medium can flow through the motor barrel 4 and the permanent magnet motor 5, and cooling of the motor barrel 4 and the permanent magnet motor 5 is achieved.

Further, a plurality of balance holes 60 distributed in an annular array mode are formed in the side, close to the pump body 1, of the pump impeller 6, so that the axial thrust borne by the bearing on the permanent magnet motor 5 is reduced, the service life of the bearing on the permanent magnet motor 5 can be prolonged, and the maintenance cost is reduced.

Further, the pump shaft 50 is connected with the front side of the pump body 1 through a first bearing 13, so that the rotation of the pump shaft 50 is facilitated. The first bearing 13 is embedded in the front side of the inner wall of the pump body 1, and a bearing washer 14 is arranged on the front side of the first bearing 13, so that the stability of the first bearing 13 is improved.

Further, an impeller front sealing ring 7 is arranged on the outer wall of the front end of the pump impeller 6, and a pump cover sealing ring 8 is arranged at the joint of the impeller front sealing ring 7 and the infusion pump cover 2, so that the sealing performance of the joint of the pump impeller 6 and the infusion pump cover 2 is ensured.

Further, an impeller rear sealing ring 9 is arranged on the outer wall of the rear end of the pump impeller 6, and a pump body sealing ring 12 is arranged at the joint of the impeller rear sealing ring 9 and the pump body 1, so that the sealing performance of the joint pump impeller 6 and the pump body 1 is ensured.

Further, the rear end of the pump shaft 50 is connected with the sealing pump cover 3 through a second bearing 15, so that the rotation of the pump shaft 50 is facilitated. The second bearing 15 is embedded in the inner side of the sealing pump cover 3. A belleville spring 16 is arranged on the rear side of the second bearing 15. The clamping sleeve right-angle joint 19 communicates with the installation space of the belleville spring 16 on the inner side of the sealing pump cover 3. The position of the pump shaft 50 can be limited through the belleville spring 16, low-temperature media can enter the pump body 1, and the motor barrel 4, the permanent magnet motor 5 and the bearing are lubricated and cooled, so that the service life is prolonged.

When the permanent magnet leakage-free low-temperature pump in the embodiment is used, an external power source is connected to supply power to the motor barrel 4 through the wiring device 24, and the permanent magnet motor 5 is started to enable the motor barrel 4 to rotate. The permanent magnet motor 5 and the pump impeller 6 are coaxial. Therefore, the pump impeller 6 can be efficiently driven to rotate under the action of the permanent magnet motor 5, so that the transmission loss is reduced. Under the action of the pump impeller 6, the low-temperature medium is conveyed to the output pipeline from the input pipeline; at the moment, a proper amount of low-temperature medium enters the pump body 1 sequentially through the clamping sleeve straight joint 17, the seamless steel tube 18 and the clamping sleeve right-angle joint 19. The pump body 1 and the motor barrel 4 are integrally designed. Therefore, the low-temperature medium enters the interior of the motor barrel 4 to achieve lubrication and cooling of the bearing. Moreover, the pump impeller 6 is of a balance hole structure, and the axial thrust borne by the bearing of the permanent magnet motor 5 can be reduced, so that the service life of the bearing is prolonged, and the maintenance cost is reduced.

The basic principles, principal features and advantages of the present disclosure are shown and described above. Those skilled in the art should understand that the present disclosure is not limited by the above-described embodiments, the above-described embodiments and specification are merely illustrative of the principles of the present disclosure without limiting the present disclosure, various changes and modifications may occur to the present disclosure under the premise of without departing from the spirit and scope of the present disclosure, and these changes and modifications fall within the scope of the present disclosure as claimed. The scope of the present disclosure is defined by the appended claims and equivalents thereof.

What is claimed is:

1. A permanent magnet leakage-free low-temperature pump, comprising a pump body (1), wherein a motor barrel (4) is arranged in the pump body (1), a permanent magnet motor (5) is arranged in the motor barrel (4), a first flange plate (10) is arranged at a position, located at the front end, of the outer wall of the pump body (1), a second flange plate (11) is arranged at a position, located at the rear end, of the outer wall of the pump body (1), a flange is arranged on the first flange plate (10), the flange is connected with an infusion pump cover (2), a third flange plate (20) is arranged on the outer wall of a liquid inlet of the infusion pump cover (2), a fourth flange plate (21) is arranged on the outer wall of a liquid outlet of the infusion pump cover (2), the outer wall of the fourth flange plate (21) is connected with a clamping sleeve straight joint (17), the clamping sleeve straight joint (17) communicates with the liquid outlet of the infusion pump cover (2), a pump impeller (6) is arranged in the infusion pump cover (2), the permanent magnet motor (5) drives the pump impeller (6) to rotate through a pump shaft (50), the front end of the pump shaft (50) is coaxially connected with the pump impeller (6), the second flange plate (11) is also provided with a flange, the flange is connected with a sealing pump cover (3), the rear end of the pump shaft (50) is rotatably connected with the inner wall of the sealing pump cover (3), the middle of the sealing pump cover (3) is connected with a clamping sleeve right-angle joint (19), the clamping sleeve straight joint (17) communicates with the clamping sleeve right-angle joint (19) through a seamless steel tube (18), an electrical connecting pipe (30) is connected to a position, close to the top, of the outer wall of the sealing pump cover (3), the electrical connecting pipe (30) is in threaded connection with an electrical adapter (23) through an electrical adapter nut (22), and the end, away from the electrical connecting pipe (30), of the electrical adapter (23) is in threaded connection with a wiring device (24).

2. The permanent magnet leakage-free low-temperature pump according to claim 1, wherein a first support (26) is in threaded connection with a position, located at the bottom, of the right side of the first flange plate (10) through a bolt, and a second support (27) is in threaded connection with a position, located at the bottom, of the left side of the second flange plate (11) through a bolt.

3. The permanent magnet leakage-free low-temperature pump according to claim 1, wherein a plurality of drainage grooves (40) arranged in an annular array mode are formed in the inner wall of the motor barrel (4).

4. The permanent magnet leakage-free low-temperature pump according to claim 1, wherein a plurality of balance holes (60) distributed in an annular array mode are formed in the side, close to the pump body (1), of the pump impeller (6).

5. The permanent magnet leakage-free low-temperature pump according to claim 1, wherein the pump shaft (50) is connected with the front side of the pump body (1) through a first angular contact ball bearing (13), the first angular contact ball bearing (13) is embedded in the front side of the inner wall of the pump body (1), and a bearing washer (14) is arranged on the front side of the first angular contact ball bearing (13).

6. The permanent magnet leakage-free low-temperature pump according to claim 1, wherein an impeller front sealing ring (7) is arranged on the outer wall of the front end of the pump impeller (6), and a pump cover sealing ring (8) is arranged at the joint of the impeller front sealing ring (7) and the infusion pump cover (2).

7. The permanent magnet leakage-free low-temperature pump according to claim 1, wherein an impeller rear sealing ring (9) is arranged on the outer wall of the rear end of the pump impeller (6), and a pump body sealing ring (12) is arranged at the joint of the impeller rear sealing ring (9) and the pump body (1).

8. The permanent magnet leakage-free low-temperature pump according to claim 1, wherein the rear end of the pump shaft (50) is connected with the sealing pump cover (3) through a second angular contact ball bearing (15), the second angular contact ball bearing (15) is embedded in the inner side of the sealing pump cover (3), and a belleville spring (16) is arranged on the rear side of the second angular contact ball bearing (15).

9. The permanent magnet leakage-free low-temperature pump according to claim 8, wherein the clamping sleeve right-angle joint (19) communicates with the belleville spring (16) on the inner side of the sealing pump cover (3).

10. The permanent magnet leakage-free low-temperature pump according to claim 1, wherein the motor barrel (4) and the pump body (1) are integrally designed, and the permanent magnet motor (5) and the pump impeller (6) are coaxial and integrally connected.

* * * * *